US011680737B2

(12) United States Patent
Durbecq et al.

(10) Patent No.: US 11,680,737 B2
(45) Date of Patent: Jun. 20, 2023

(54) PLUG-IN DEVICE FOR A CYLINDER OF A CONDENSER

(71) Applicant: Valeo Systemes Thermiques, Le Mesnil-Saint-Denis (FR)

(72) Inventors: Gaël Durbecq, Reims (FR); Véronique Westermann, Reims (FR)

(73) Assignee: Valeo Systemes Thermiques, Le Mesnil-Saint-Denis (FR)

( * ) Notice: Subject to any disclaimer, the term of this patent is extended or adjusted under 35 U.S.C. 154(b) by 7 days.

(21) Appl. No.: 16/975,503

(22) PCT Filed: Feb. 6, 2019

(86) PCT No.: PCT/EP2019/052847
§ 371 (c)(1),
(2) Date: Aug. 25, 2020

(87) PCT Pub. No.: WO2019/162088
PCT Pub. Date: Aug. 29, 2019

(65) Prior Publication Data

US 2021/0033319 A1 Feb. 4, 2021

(30) Foreign Application Priority Data

Feb. 26, 2018 (FR) ..... 1800171

(51) Int. Cl.
*F25B 39/04* (2006.01)
*F25B 43/00* (2006.01)
*F28D 21/00* (2006.01)

(52) U.S. Cl.
CPC ..... *F25B 39/04* (2013.01); *F25B 43/003* (2013.01); *F25B 2339/0441* (2013.01);
(Continued)

(58) Field of Classification Search
CPC F25B 39/04; F25B 43/003; F25B 2339/0441; F25B 2400/162; F28D 2021/007; F28D 2021/0084; F28F 2220/00
See application file for complete search history.

(56) References Cited

U.S. PATENT DOCUMENTS 5,666,791 A * 9/1997 Burk ..... B60H 1/3227 62/474
5,992,174 A 11/1999 Mittelstrass
(Continued)

FOREIGN PATENT DOCUMENTS

DE 19712714 A1 10/1998
DE 10213176 A1 10/2003
(Continued)

OTHER PUBLICATIONS

Machine translation of JP2009121782 (Year: 2009).*
(Continued)

*Primary Examiner* — Joseph F Trpisovsky
(74) *Attorney, Agent, or Firm* — Osha Bergman Watanabe & Burton LLP

(57) ABSTRACT

A plug-in device for a cylinder of a condenser, this plug-in device comprising: a plug designed to plug, preferably removably, an opening of the cylinder, a functional component designed to interact with a refrigerant fluid in the cylinder, this functional component being designed to be mounted, removably or non-removably, on the plug with the possibility of rotating with respect to this plug.

6 Claims, 2 Drawing Sheets

Figure 1:
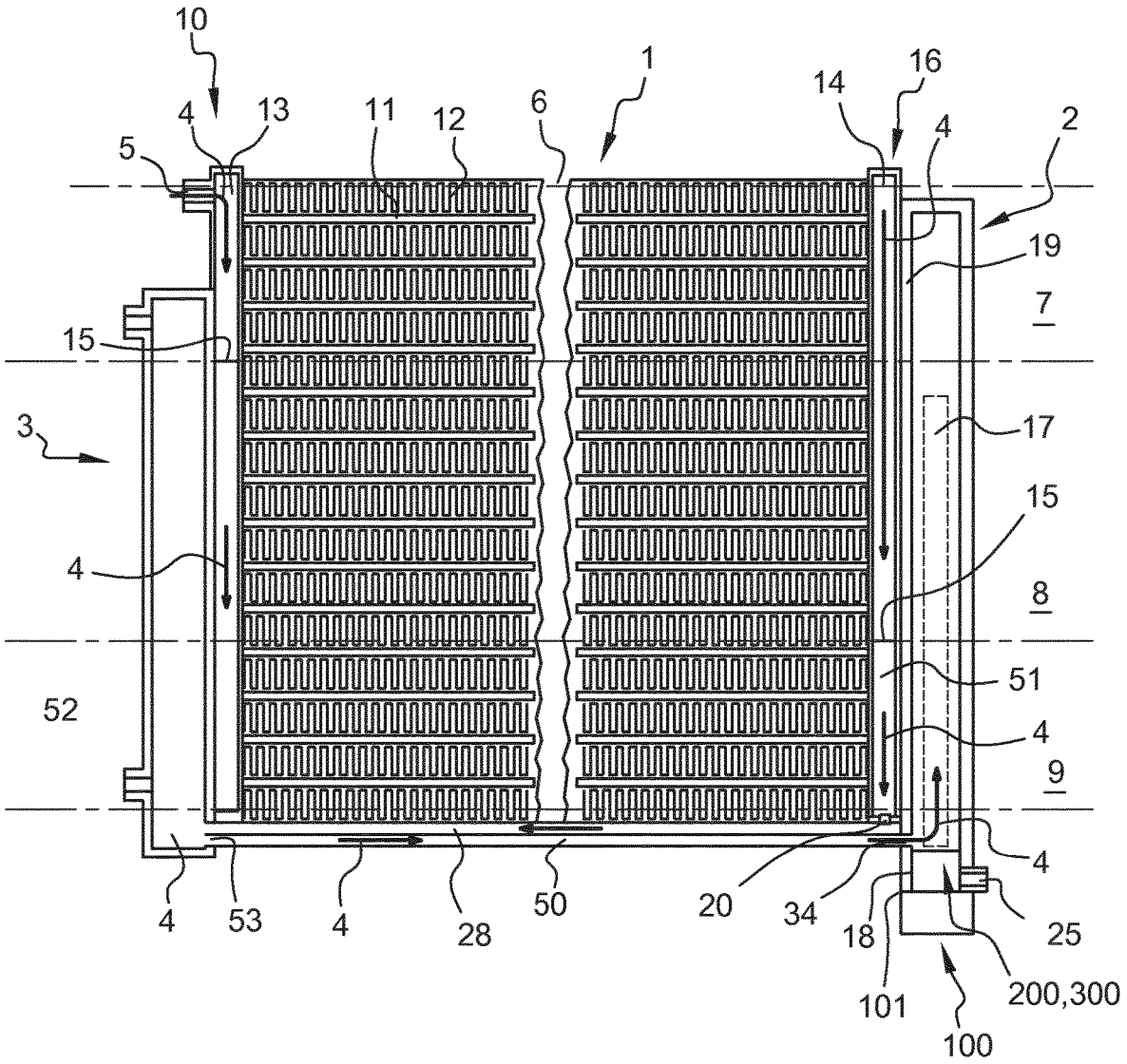

(52) U.S. Cl.
CPC .. *F25B 2400/162* (2013.01); *F28D 2021/007* (2013.01); *F28D 2021/0084* (2013.01); *F28F 2220/00* (2013.01)

(56) References Cited

U.S. PATENT DOCUMENTS

| | | | | |
|---|---|---|---|---|
| 6,918,436 | B2 * | 7/2005 | Kaspar | F25B 39/04 165/173 |
| 2002/0023448 | A1 * | 2/2002 | Ito | F25B 39/04 62/222 |
| 2005/0178147 | A1 * | 8/2005 | Kaspar | F25B 43/003 62/509 |
| 2008/0314252 | A1 | 12/2008 | Min et al. | |

FOREIGN PATENT DOCUMENTS

| | | | |
|---|---|---|---|
| EP | 1386653 | A1 | 2/2004 |
| EP | 1577629 | A1 | 9/2005 |
| FR | 2879169 | A1 | 6/2006 |
| JP | 2009079806 | A | 4/2009 |
| JP | 2009121782 | A | 6/2009 |

OTHER PUBLICATIONS

Machine translation of EP1577629 (Year: 2005).*
International Search Report and Written Opinion in corresponding International Application No. PCT/EP2019/052847, dated Apr. 17, 2019 (10 pages).
First Office Action in corresponding Chinese Application No. 201980022168.3, dated Jun. 15, 2021 (16 pages).

* cited by examiner

PLUG-IN DEVICE FOR A CYLINDER OF A CONDENSER

The present invention relates to a plug-in device for a cylinder, notably of a condenser.

The invention finds a particularly advantageous application in the field of motor vehicle aid conditioning. Document EP1386653 for example discloses a refrigerant fluid reservoir cylinder.

In general, air conditioning circuits need to meet a certain number of strict criteria regarding the ambient conditions in which the refrigerant fluid, such as the fluid known by the name R134A, for example, circulates.

Specifically, it is necessary to avoid the presence in the circuit of excessive number or excessively large sized foreign bodies, because these can cause problems which may lead to the breakage of certain components of the air conditioning circuits, such as the compressor.

On the other hand, the refrigerant fluid needs to be able to circulate in an environment that is free of moisture, because water molecules have a tendency to produce acid compounds in the presence of R134A and of oil. These compounds then attack the components of the circuit, and this may lead to leaks and to the loss of functionalities.

It is known practice to fit air conditioning circuits with cylinders containing a certain quantity of refrigerant fluid in the liquid phase. These cylinders act, on the one hand, as reservoirs of fluid intended to compensate for any potential leaks in the circuits, and, on the other hand, serve to ensure that, on leaving the cylinders, the refrigerant fluid is entirely in the liquid phase before it is conveyed further downstream. In specific embodiments, the outlet of the cylinder is returned to a section of the condenser to cause the liquid refrigerant fluid to perform an additional pass, referred to as a supercooling pass.

It is also known practice to make use of the presence of reservoirs cylinders in the path followed by the refrigerant fluid in order to resolve the ambient-condition problems mentioned above. To this end, a filter and a desiccator may be placed inside the cylinders in order to eliminate as far as possible the presence of foreign bodies and moisture in the loops through which the refrigerant fluid circulates.

The cylinder, which is then referred to as a dehydration cylinder is, in most cases, incorporated into the air conditioning condenser, so as to have part of the condenser devoted to the supercooling of the refrigerant and therefore improve the performance of the air conditioning loop.

As mentioned above, this cylinder generally has a number of functions:

- creating a reserve of refrigerant to compensate for the inevitable losses over the life of the vehicle
- creating separation between gas phase and liquid phase
- filtering the refrigerant by adding a filter situated between the inlet and the outlet of the cylinder
- absorbing moisture inside the air conditioning loop by adding a bag of desiccant inside the cylinder.

Each motor manufacturer has its own requirements regarding the maintenance of the air conditioning loop over the life of the vehicle:

- certain manufacturers demand that the cylinder be sealed, with no possibility of access to any of its internal components
- certain manufacturers demand that the cylinder be able to be opened so that the filter and the desiccant can be replaced during operation operations.

Within this second category, certain manufacturers demand that the cylinder be able to opened from the top, and others from the bottom.

The second constraint imposed on the cylinder is connected with the position of the supercooling pass. For module design reasons, certain manufacturers demand that the supercooling pass is situated at the top of the condenser, whereas in most cases it is situated at the bottom. This is because of the presence of another exchanger, generally the charge air cooler, situated upstream, in the bottom part of the module, and which would warm up the air sent over the supercooling pass of the condenser.

The invention seeks to address the aforementioned requirements.

One subject of the invention is a plug-in device for a cylinder notably of a condenser, this plug-in device comprising:

- a plug designed to plug, preferably removably, an opening of the cylinder,
- a functional component designed to interact with a refrigerant fluid in the cylinder, this functional component being designed to be mounted, removably or non-removably, on the plug with the possibility of rotating with respect to this plug.

The invention makes it possible not to wear the functional components when screwing the plug onto the cylinder.

As will be seen, the invention also allows a diversity of configurations thanks to the modular nature of the cylinder, so that a maximum of existing components can be reused.

According to one exemplary embodiment of the invention, the functional component is selected from a filter designed to filter impurities in the refrigerant fluid, and a separator designed to impose a flow path on the refrigerant fluid.

According to one exemplary embodiment of the invention the separator is designed to separate an inlet and an outlet of the cylinder, notably so as to force the refrigerant to pass through a filter, notably in the bottom part, and through a dip tube for raising the refrigerant back up to the top of the condenser, toward a supercooling pass.

According to one exemplary embodiment of the invention, the functional component is designed to be mounted on the plug by clip-fastening.

According to one exemplary embodiment of the invention, the functional component comprises a clip-fastening part, notably of substantially annular shape.

According to one exemplary embodiment of the invention, the clip-fastening part comprises a bead, notably an annular bead.

According to one exemplary embodiment of the invention, the clip-fastening part comprises at least one opening, notably substantially adjacent to the bead.

According to one exemplary embodiment of the invention, the plug comprises a complementary clip-fastening part.

According to one exemplary embodiment of the invention, the clip-fastening part of the plug comprises a cavity designed to at least partially accept the clip-fastening part of the functional component.

According to one exemplary embodiment of the invention, this cavity comprises at least one groove to accept the bead of the functional component.

According to one exemplary embodiment of the invention, the clip-fastening parts are designed to be able to be free to rotate relative to one another.

As an alternative, the clip-fastening part of the functional component is of the female type and the clip-fastening part of the plug is of the male type.

According to one exemplary embodiment of the invention, the plug is designed to be screwed onto the cylinder and comprises a screw thread.

According to one exemplary embodiment of the invention, the plug is made from PA66, PA66 or GF30.

According to one exemplary embodiment of the invention, the filter comprises a sealing lip designed to be pressed against a wall of the cylinder. As the filter does not rotate with respect to the cylinder, notably while it is being mounted, the lip is spared, which means to say does not become worn by friction against the cylinder.

A further subject of the invention is an assembly for a motor vehicle heat exchanger, this assembly comprising:

- a plug designed to plug in a cylinder associated with this heat exchanger,
- a functional component of a first type, designed to be able to be mounted on the plug,
- a functional component of a second type, designed to be able to be mounted on the plug in place of the first functional component.

The invention allows a modularity according to the needs.

Yet another subject of the invention is a cylinder comprising an aforementioned plug and a functional component mounted on this plug.

Yet another subject of the invention is a heat exchanger, notably a condenser, comprising the cylinder and the plug.

Yet another subject of the invention is a method for assembling a cylinder, comprising the step of mounting a functional component on a plug.

According to one exemplary embodiment of the invention, the functional component is selected from a number of components of different types, according to the needs.

Figure 2:
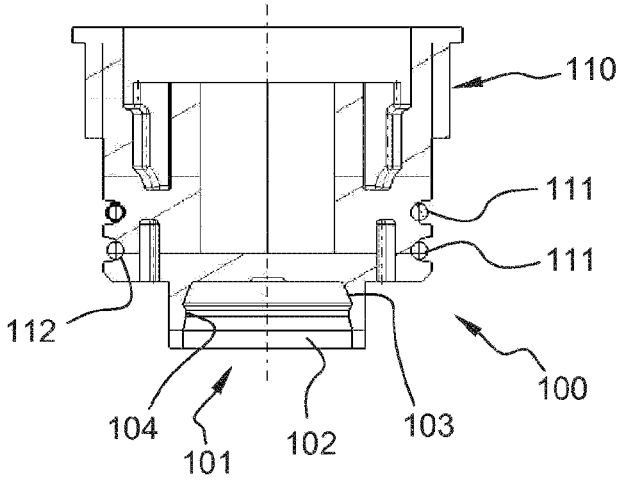
Figure 3:
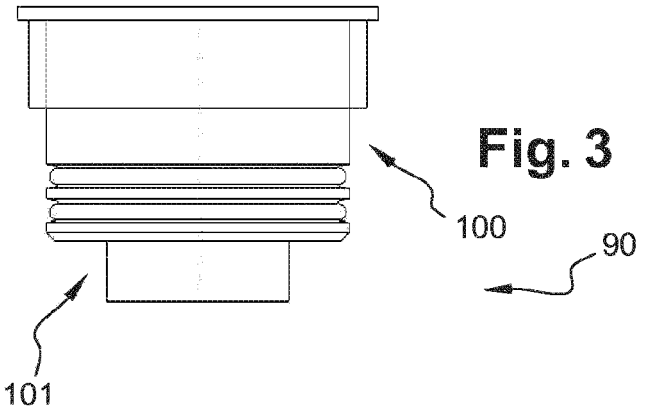
Figure 4:
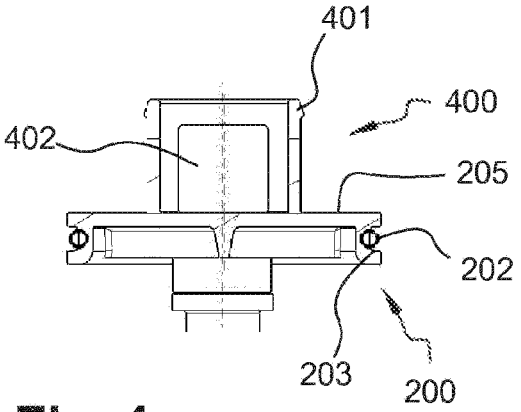
Figure 5:
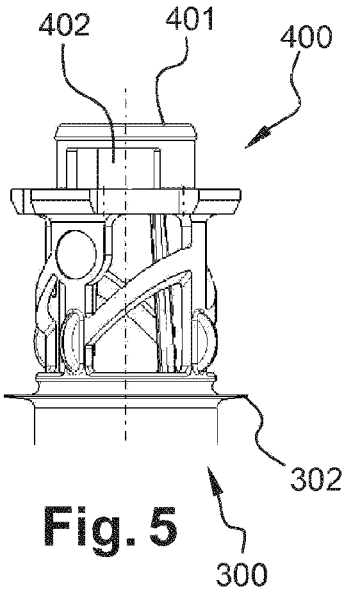

Further features, details and advantages of the invention will become more clearly apparent from reading the description given hereafter by way of indication with reference to the drawings in which:

FIG. 1 is a view of a condenser and of a cylinder according to the invention, FIG. 2 is a view in cross section of a plug according to the invention, FIG. 3 is a side view of the plug of FIG. 2, FIG. 4 is view in cross section of a functional component formed by a separator according to the invention, FIG. 5 is a side view of a functional component formed by a filter according to the invention.

FIG. 1 illustrates a condenser 1, a cylinder 2 and an internal heat exchanger 3. These three components of an air conditioning loop are combined to form an assembly or system through which there passes a refrigerant fluid symbolized by arrows referenced 4.

The condenser 1 comprises a core bundle 6 through which there passes a flow of air external to the vehicle. This core bundle comprises a multitude of flat tubes 11 which extend transversely with respect to the external air flow. These flat tubes 11 carry the refrigerant fluid 4 between a first header tank 13 and a second header tank 14. These header tanks 13 and 14 are therefore fluidically connected to each flat tube 11 and are partitioned into a refrigerant fluid distribution chamber in groups of flat tubes thus forming passes 7, 8 and 9 for the circulation of the refrigerant fluid. The partitioning of the header tanks is performed by separators 15 installed across the header tank so as to force the refrigerant fluid to circulate in the relevant pass.

Installed between each flat tube 11 is an insert or fin 12 the purpose of which is to increase the surface area for exchange of heat between the refrigerant fluid and the external air flow.

These header tanks 13, 14 therefore respectively form a first side 10 of the core bundle 6 and a second side 16 flanking the core bundle and on the opposite side of the core bundle 6 to the first side 10.

The refrigerant fluid 4 enters the system via a high-pressure inlet orifice 5 of the condenser 1, this inlet orifice 5 being more particularly installed on the wall of the first header tank 13 and in the upper part thereof.

A cylinder 2 is mounted against the second side 16. By way of example, the cylinder 2 and the header tank 14 may share a wall 19 which thus jointly delimits the internal volume of the cylinder 2 and the internal volume of the header tank 14.

This cylinder takes the form of a tube extending over substantially the entire height of the core bundle 6 and inside which there is installed a desiccant 17 and a filter 18. The desiccant 17 has the function of capturing water particles circulating in the refrigerant fluid 4, whereas the filter 18 captures solid particles circulating in the refrigerant fluid and which are the result of the wearing of the components of the air conditioning loop.

The system according to the invention comprises a first duct 28 and a second duct 50 which extend in the core bundle 6 of the first side 10 to the second side 16.

The first duct 28 places a distribution chamber 51 delimited by the walls of the second header tank in communication with a high-pressure inlet 52 of the internal heat exchanger 3, this inlet being positioned facing the first duct 28 in the lower part of the internal heat exchanger. The refrigerant fluid 4 therefore circulates from the distribution chamber towards the internal heat exchanger. This communication is established by means of an outlet orifice 20 of the condenser which is made in the wall of the distribution chamber 51 and in the first duct 28.

The second duct 50 places a high-pressure outlet 53 of the internal heat exchanger in communication with the cylinder 2, more particularly with the internal volume thereof in which the desiccant 17 extends. This communication is established via an inlet 34 in the wall 19 of the cylinder 2, substantially facing the second duct 50 and above the filter 18.

The internal heat exchanger comprises means which are organized in such a way that the circulation of the refrigerant fluid, here subjected to high pressure and high temperature, ascends vertically through the internal heat exchanger after having arrived via the high-pressure inlet 52, then descends vertically towards the high-pressure outlet 53 before entering the second duct 50.

A refrigerant outlet 25 from the cylinder is provided.

The condenser may of course be arranged differently.

FIGS. 2 to 5 depict elements of a plug-in device 90 for a cylinder according to the invention, this plug-in device comprising:

- a plug 100 designed to plug, removably, an opening 101 of the cylinder 2,
  - a functional component 200; 300, designed to interact with a refrigerant fluid in the cylinder 2;
  - this functional component 200; 300 being designed to be mounted, removably or non-removably, on the plug with the possibility of rotating with respect to this plug 100.

The functional component is selected from a filter 300, designed to filter impurities in the refrigerant fluid, and a separator 200 designed to impose a flow path on the refrigerant fluid.

The separator 200 is designed to separate an inlet 34 and an outlet 25 of the cylinder, notably so as to force the refrigerant to pass through a filter, notably in the bottom part, and through a dip tube in order to raise the refrigerant back up to the upper part of the condenser, towards a supercooling pass.

The functional components 200 and 300 are designed to be mounted on the plug 100 by clip-fastening.

Each functional component 200, 300 comprises a clip-fastening part 400 of substantially annular shape.

The clip-fastening part 400 comprises an annular bead 401 and openings 402 substantially adjacent to the bead 401.

The plug 100 comprises a complementary clip-fastening part 101, as can be seen in FIGS. 2 and 3.

This clip-fastening part 101 of the plug 100 comprises a cavity 102 designed to accept the clip-fastening part 400 of the functional component 200; 300.

This cavity 102 comprises an annular groove 103 to accept the bead 401 of the functional component 200; 300.

This groove 103 may have an insertion rim 104 which is flared to allow removable assembly of the functional component with respect to the plug. As an alternative, this rim 104 may be straight and prevent the functional component from being removed once it is in place on the plug 100.

The complementary clip-fastening parts 101 and 400 are designed to be able to be free to rotate with respect to one another.

As an alternative, the clip-fastening part of the functional component is of the female type and the clip-fastening part of the plug is of the male type.

The plug 100 is designed to be screwed onto the cylinder 2 and comprises a screw thread 110, as illustrated in FIGS. 2 and 3.

The plug 100 further comprises annular seals 111 housed in grooves 112 to provide sealing once mounted on the cylinder 2.

As illustrated in FIG. 4, the separator 200 comprises an annular seal 202 housed in a groove 203.

The separator 200 comprises a flange 205 adjacent to the clip-fastening part 400.

The separator also accepts a pipe on the opposite side to the clip-fastening into the plug, so that the refrigerant can ascend from the bottom towards the top of the cylinder, the supercooling pass being at the top in this application.

As illustrated in FIG. 5, the filter 300 comprises a sealing lip 302 designed to press against a wall of the cylinder 2. Because the filter does not turn with respect to the cylinder, notably while it is being fitted, the lip 302 is spared, namely does not become worn by friction against the cylinder.

The plug 100 can just as well accept the separator 200 as the filter 300, according to choice.

The invention claimed is:

1. A plug-in device for a cylinder of a condenser, the plug-in device comprising:

a plug configured to removably plug an opening of the cylinder; and a separator configured to impose a flow path on a refrigerant fluid in the cylinder, the separator being mounted, removably or non-removably, on the plug and configured to rotate with respect to the plug;

wherein the separator is configured to be mounted on the plug by an annularly shaped clip-fastening part, and wherein the clip-fastening part comprises a continuous annular bead and openings adjacent to the bead.

2. The device according to claim 1, in which the plug comprises a complementary clip-fastening part.

3. The device according to claim 2, in which the clip-fastening part of the separator and the complementary clip-fastening part of the plug are designed to be able to be free to rotate relative to one another, once assembled.

4. The device according to claim 1, in which the plug is configured to be screwed onto the cylinder and comprises a screw thread.

5. A method for assembling a cylinder, comprising: mounting a separator on a plug of a plug-in device according to claim 1.

6. A cylinder comprising:

a plug-in device having a plug configured to removably plug an opening of the cylinder; and a separator configured to impose a flow path on a refrigerant fluid in the cylinder;

wherein the separator is mounted on the plug by an annularly shaped clip-fastening part and configured to rotate with respect to the plug; and wherein the clip-fastening part comprises a continuous annular bead and openings adjacent to the bead.

* * * * *